US009782826B2

(12) United States Patent
Funato et al.

(10) Patent No.: US 9,782,826 B2
(45) Date of Patent: Oct. 10, 2017

(54) SLIDING NOZZLE DEVICE

(71) Applicant: KROSAKIHARIMA CORPORATION, Fukuoka (JP)

(72) Inventors: Junici Funato, Fukuoka (JP); Nobuyuki Yokoi, Fukuoka (JP); Toshihiro Imahase, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 96 days.

(21) Appl. No.: 14/780,041

(22) PCT Filed: Mar. 25, 2014

(86) PCT No.: PCT/JP2014/058210
§ 371 (c)(1),
(2) Date: Sep. 25, 2015

(87) PCT Pub. No.: WO2014/157157
PCT Pub. Date: Oct. 2, 2014

(65) Prior Publication Data

US 2016/0045956 A1 Feb. 18, 2016

(30) Foreign Application Priority Data

Mar. 27, 2013 (JP) ..... 2013-067044
Sep. 26, 2013 (JP) ..... 2013-200144

(51) Int. Cl.
*B22D 41/32* (2006.01)
*B22D 41/24* (2006.01)
(Continued)

(52) U.S. Cl.
CPC ..... *B22D 41/32* (2013.01); *B22D 41/22* (2013.01); *B22D 41/24* (2013.01); *B22D 41/28* (2013.01); *F27D 3/14* (2013.01)

(58) Field of Classification Search
CPC ..... B22D 41/40; B22D 41/24
(Continued)

(56) References Cited

U.S. PATENT DOCUMENTS 4,650,101 A 3/1987 Fricker
6,276,573 B1 * 8/2001 Tofuku ..... B22D 41/40 222/590

(Continued)

FOREIGN PATENT DOCUMENTS

JP S61189867 A 8/1986
JP 63-30105 6/1988
JP H1157989 A 3/1999
JP 2006136912 A 6/2006

OTHER PUBLICATIONS

English translation of International Preliminary Report on Patentability dated Sep. 29, 2015 for PCT/JP2014/058210 filed Mar. 25, 2014.

(Continued)

*Primary Examiner* — Scott Kastler
(74) *Attorney, Agent, or Firm* — Paul D. Bianco; Gary S. Winer; Fleit Gibbons Gutman Bongini & Bianco PL

(57) ABSTRACT

A sliding nozzle device that can reduce any damage such as surface roughness and chipping in a nozzle hole surroundings of a used plate. The sliding nozzle device includes a fixed metal frame, a sliding metal frame, and an opening and closing metal frame that holds the sliding metal frame in a slidable manner, and in the sliding nozzle device in which sliding contact surfaces of the sliding members provided on the sliding metal frame and the opening and closing metal frame come in slidable contact with each other, the sliding contact surfaces of the sliding member of the sliding metal frame are provided away from each other by a predetermined length front and rear in the sliding direction and a part between the front and rear sliding contact surfaces serves as (Continued)

a depressed part, and the sliding contact surfaces of the sliding member of the opening and closing metal frame are provided away from each other by a predetermined length front and rear in the sliding direction and a part between the front and rear sliding contact surfaces serves as a depressed part.

19 Claims, 4 Drawing Sheets

(51) Int. Cl.
*B22D 41/28* (2006.01)
*B22D 41/22* (2006.01)
*F27D 3/14* (2006.01)

(58) Field of Classification Search
USPC ..... 222/600
See application file for complete search history.

(56) References Cited

U.S. PATENT DOCUMENTS

| | | | | |
|---|---|---|---|---|
| 7,455,201 | B2 | 11/2008 | Mitsui | |
| 2004/0026467 | A1* | 2/2004 | Plattner | B22D 41/40 222/600 |
| 2007/0267591 | A1* | 11/2007 | Mitsui | B22D 41/24 251/302 |
| 2016/0045956 | A1* | 2/2016 | Funato | B22D 41/24 164/337 |

OTHER PUBLICATIONS

Written Opinion dated Sep. 27, 2015 for PCT/JP2014/058210 filed Mar. 25, 2014 (English translation).
International Search Report dated Apr. 14, 2014 for PCT/JP2014/058210 filed Mar. 25, 2014.

* cited by examiner

SLIDING NOZZLE DEVICE

FIELD OF THE INVENTION

The present invention relates to a sliding nozzle device for controlling a flow rate of molten steel.

BACKGROUND OF THE INVENTION

A sliding nozzle device is for example attached to a discharge outlet of a ladle, and controls a flow rate of molten steel by stacking two pieces of refractory plates that have a nozzle hole, and linearly sliding the lower plate with respect to the upper plate in a surface pressure loaded state, to vary an aperture of the nozzle hole.

Such a sliding nozzle device generally includes a fixed metal frame for holding an upper plate, a sliding metal frame for holding a lower plate and which slides linearly to slide the lower plate with respect to the upper plate, an opening and closing metal frame for holding the sliding metal frame in a slidable manner, an elastic body for loading a surface pressure between the upper and lower plates, and a driving device for driving the sliding metal frame. In this configuration, the sliding metal frame slides in a state in contact with the opening and closing metal frame under high pressure, and thus is in contact with the opening and closing metal frame via sliding members.

As such, the upper and lower plates are relatively moved slidingly in a state in which surface pressure is loaded, and are further used at high temperatures. Moreover, since the plate comes in direct contact with molten steel at an inner circumference plane of the nozzle hole during the casting, the temperature thereof becomes high as compared to its surroundings, and the plate expands around the nozzle hole. Among this expansion, the expansion along a nozzle hole center axis direction (molten steel flowing direction) is understood as causing damage on the plate. Namely, just the peripheral parts of the nozzle hole of the upper and lower plates come in contact with each other by the expansion along the center axis direction of the nozzle hole; this causes the plates to warp in opposite directions from each other, thus causing the surface pressure to concentrate on the nozzle hole surroundings. It is considered that damage such as chipping in the nozzle hole surroundings and surface roughness on the most important surface occur due to frequent sliding of the plates in order to change aperture of the nozzle hole, to control the flow rate in this state.

In order to prevent this damage, Patent Document 1 proposes to provide a depressed part around the nozzle hole of the plate. However, if the depressed part is provided as in Patent Document 1, there may be the risk of molten steel leakage from around the nozzle hole, depending on variation in use conditions such as a case in which the preheating of the plate is insufficient.

Meanwhile, known sliding contact systems with the aforementioned sliding metal frame in a sliding nozzle device include: a liner system in which metal liners are made in slidable contact with each other, and a roller system in which slidable contact is achieved by a roller.

In Patent Document 2, as one example of the former liner system, an opening and closing metal frame (cover housing) is disposed under a sliding metal frame (frame body), and two liners made of metal that extend in the sliding direction of the sliding metal frame are provided to each of the sliding metal frame and the opening and closing metal frame as sliding members. Namely, in this system, the two liners provided on either side of a center line of the sliding metal frame along the sliding direction comes into sliding contact with the liners on the opening and closing metal frame. However, in this system, the liners on the sliding metal frame and the liners on the opening and closing metal frame come in contact with each other in a slidable manner for the whole length of the slidable range of the sliding metal frame; thus, when the nozzle hole surroundings of the plate expand in the center axis direction of the nozzle hole as described above, this expansion cannot be absorbed, and damages occur such as the chipping in the nozzle hole surroundings and the surface roughness on the most important surfaces.

As one example of the latter roller system, Patent Document 3 discloses a system in which two rollers are provided on each side of a sliding metal frame (slide case) as sliding members, and the sliding metal frame is slid by having the opening and closing metal frame (surface pressure loaded member) serve as a rail. The main object of this system, is to reduce friction resistance by using the rollers and to make the size of the driving system compact. However, in this system, pressure from the opening and closing metal frame (surface pressure loaded member) is received just by the four rollers; in long term use, parallelism of the sliding plane thus cannot be secured due to wearing of the rollers or deformation of the roller shaft, and gaps readily generate between plate surfaces. This as a result causes problems that the plate wears and damages increase.

Since the plate comes into sliding contact under high temperature and high pressure in the sliding nozzle device as such, there is a problem that damages such as surface roughness and chipping of the nozzle holes readily occur, caused by for example the thermal expansion described above or the deformation of the device.

CITED PATENT DOCUMENTS

[Patent Document 1] Japanese Unexamined Patent Publication No. H11-57989

[Patent Document 2] Japanese Unexamined Patent Publication No. S61-189867

[Patent Document 3] Japanese Unexamined Patent Publication No. 2006-136912

SUMMARY OF THE INVENTION

An object of the present invention is to provide a sliding nozzle device that can reduce the occurrence of damage on a plate to be used, such as surface roughness and chipping in the nozzle hole surroundings.

According to the present invention, a sliding nozzle device of the following (1) to (6) are provided.

(1) A sliding nozzle device comprising: a fixed metal frame for holding an upper plate that has a nozzle hole; a sliding metal frame for holding a lower plate that has a nozzle hole of identical diameter as the nozzle hole of the upper plate, configured to linearly slide to move the lower plate in a sliding manner with respect to the upper plate; an elastic body for loading surface pressure between the upper plate and the lower plate; an opening and closing metal frame attached to the fixed metal frame, for holding the sliding metal frame in a slidable manner; and a driving device of the sliding metal frame, the sliding metal frame and the opening and closing metal frame each having a sliding member disposed symmetrical about a sliding direction center line of the sliding metal frame and parallel to a sliding direction, and the sliding members coming into contact with each other on their sliding contact surfaces in a sliding manner, wherein the sliding contact surfaces of the sliding member of the opening and closing metal frame are provided front and rear along the sliding direction, away from each other by a length of a nozzle hole diameter or more from a plane serving as a center, the plane passing through a center axis of the nozzle hole of the upper plate and being perpendicular to the sliding direction, and a part between the front and rear sliding contact surfaces serves as a depressed part.

(2) The sliding nozzle device according to (1), wherein the sliding contact surfaces of the sliding member of the sliding metal frame are provided away from each other by a length of a most important surface or more, the most important surface passing through a center of the most important surface of the lower plate, the center being perpendicular to the sliding direction, and a part between the front and rear sliding contact surfaces serves as a depressed part.

(3) The sliding nozzle device according to (1) or (2), wherein a total of a minimum sliding contact area that is a minimum value of an area at which the sliding contact surfaces contact with each other at a time of use is 40 $cm^2$ or more.

(4) The sliding nozzle device according to (1), (2) or (3), wherein the sliding members on the opening and closing metal frame and the sliding members on the sliding metal frame are each provided capable of being fit in a depressed part of the sliding metal frame and a depressed part of the opening and closing metal frame, and by sliding the metal frame sliding, surface pressure is released when the sliding member on the opening and closing metal frame and the sliding member on the sliding metal frame are fit to their respective depressed parts, and surface pressure is loaded when the sliding member on the opening and closing metal frame and the sliding member on the sliding metal frame contact with each other via their sliding contact surfaces.

(5) The sliding nozzle device according to (4), wherein each of the sliding members has an inclination surface continuing from a bottom surface of the depressed part to the sliding contact surface in the sliding direction, and these inclination surfaces are provided at identical inclination angles and in identical directions, whose inclination angle is 25 degrees or less, and an R of a corner section where the inclination surface and the sliding contact surface continue is 40 mm or more.

(6) The sliding nozzle device according to (5), wherein each of the sliding members has a surface Shore hardness Hs of 60 or more.

According to the present invention, by providing the sliding contact surfaces of the opening and closing metal frame away from each other by a predetermined length or more at the front and rear in the sliding direction and further making the part between the front and rear sliding contact surfaces serve as a depressed part, the sliding metal frame and the plate can warp toward the inside of the depressed part when the nozzle hole surrounding of the plate thermally expands in the center axis direction. Therefore, the plates can come in contact with each other at broad surfaces even during thermal expansion, and pressure acting on the nozzle hole surroundings can be made smaller than conventional liner systems.

Moreover, the sliding metal frame and the opening and closing metal frame slide via surface contact of the sliding contact surfaces, and thus surface pressure (pressure) is dispersed as compared to the roller system described above. Since no excess pressure is applied on the sliding contact surface, deformation of the sliding contact surface does not occur readily even with long term use.

As described above, the present invention can reduce any damage such as surface roughness of the plate and chipping in the nozzle hole surroundings caused by thermal expansion or deformation of the device.

BRIEF DESCRIPTION OF THE DRAWINGS

FIG. 5A-5C represent a cross section along a B-B direction in FIG. 3, in which FIG. 5A shows a case in which the sliding metal frame is positioned at a fully open position, FIG. 5B shows a case in which the sliding metal frame is positioned at a fully closed position, and FIG. 5C shows a case in which the sliding metal frame is positioned at a plate replacement position.

DETAILED DESCRIPTION OF EXEMPLARY EMBODIMENTS

Figure 1:
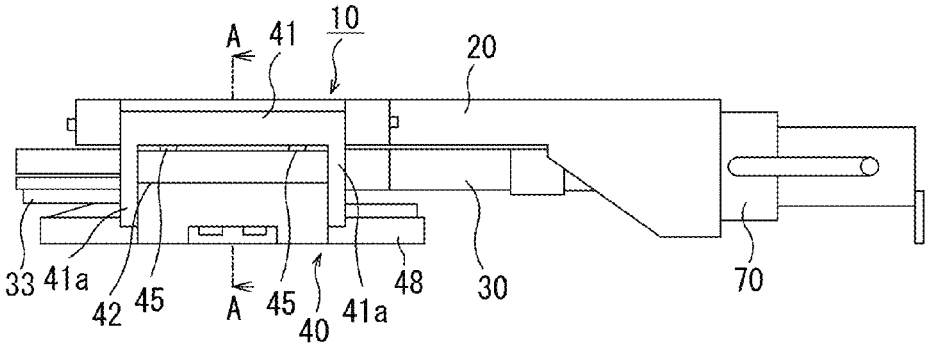
FIG. 1 is a front view showing a first Example of a sliding nozzle device according to the present invention.

Described below is an embodiment of the present invention, based on a first Example shown in the drawings.

Figure 2:
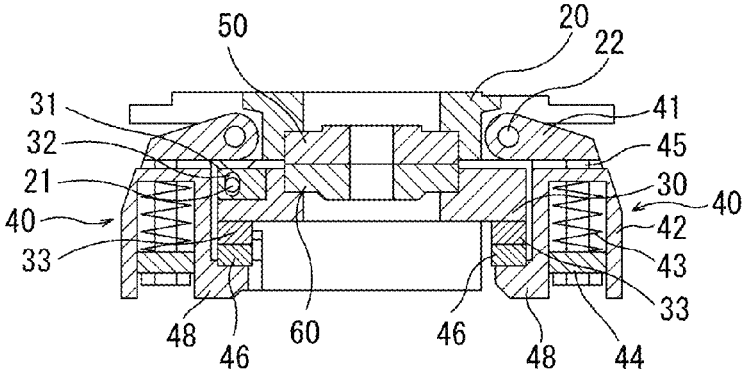
FIG. 2 is a cross section view of line A-A in FIG. 1.
Figure 3:
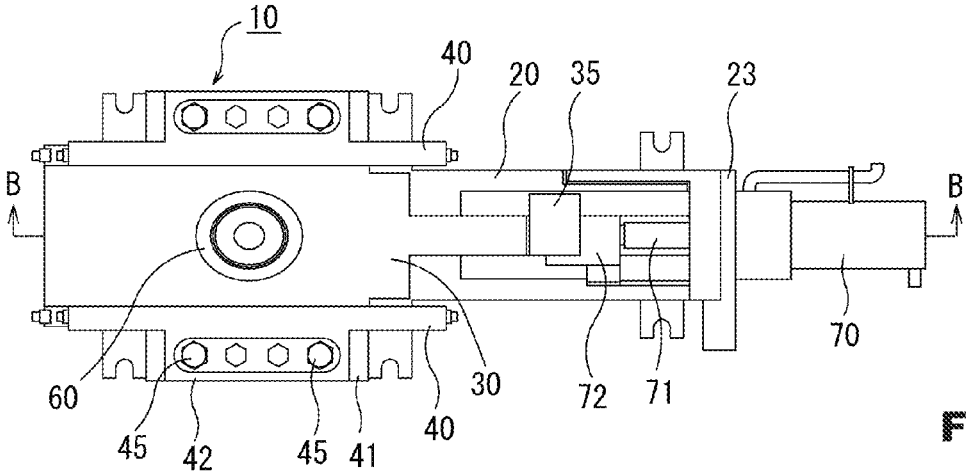
FIG. 3 is a plane view of the sliding nozzle device in FIG. 1.
Figure 4:
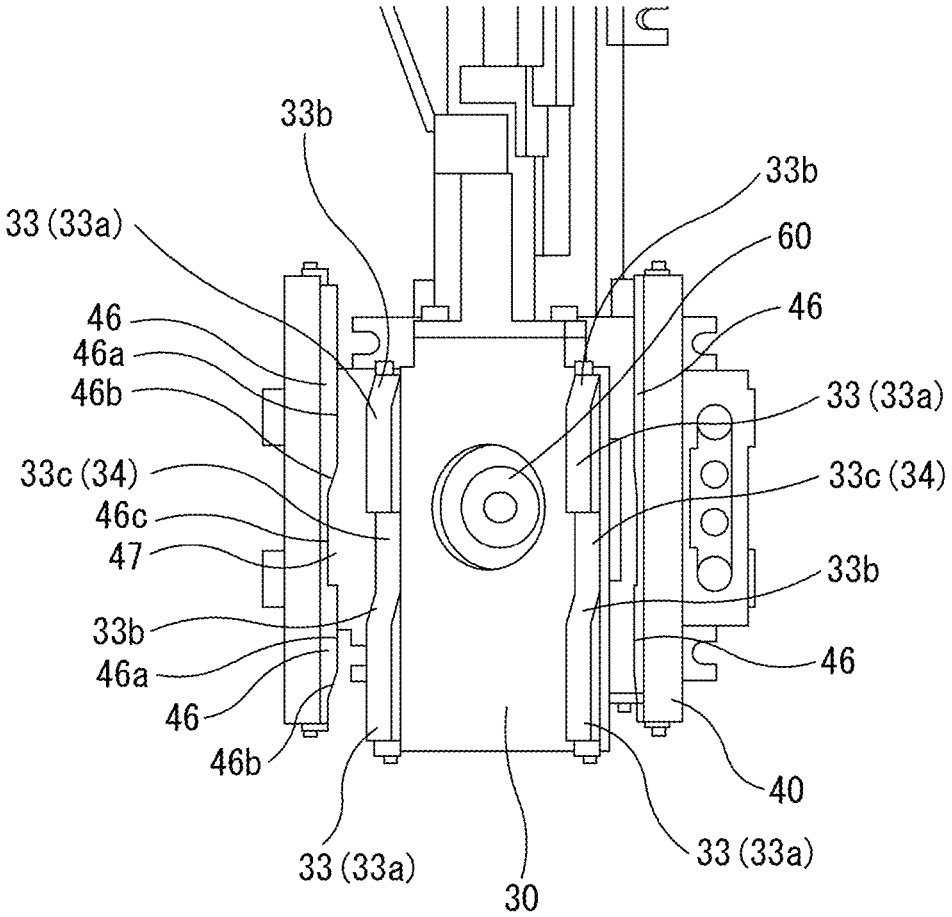
FIG. 4 is a perspective view showing a state in which opening and closing metal frames are opened, with an oil cylinder side of the sliding device of FIG. 1 facing upwards.

FIG. 1 is a front view showing a first Example of a sliding nozzle device according to the present invention, FIG. 2 is a cross section view along line A-A in FIG. 1, and FIG. 3 is a plane view. FIG. 4 is a perspective view showing a state in which an opening and closing metal frame is open with an oil cylinder side of the sliding device of FIG. 1 facing upwards.

As shown in FIG. 1 and FIG. 2, a sliding nozzle device 10 according to the present invention includes a fixed metal frame 20 attached to the bottom of a molten metal container such as a ladle, a sliding metal frame 30 attached in a slidable and openable manner with respect to the fixed metal frame 20, and two opening and closing metal frames 40 attached in an openable manner with respect to the fixed metal frame 20. Moreover, an upper plate 50 is held and fixed to the fixed metal frame 20, and a lower plate 60 is held and fixed to the sliding metal frame 30, each by a publicly known fixing method. An upper nozzle attached on the upper plate 50 and a lower nozzle attached below the lower plate 60 have been omitted.

Although not shown, the fixed metal frame 20 is attached to a shell on the bottom of the molten metal container, by using a bolt or the like. Moreover, the fixed metal frame 20 is attached with an oil cylinder 70 as a driving device for sliding the sliding metal frame 30 in a linear manner.

As shown in FIG. 2, the sliding metal frame 30 is coupled to the fixed metal frame 20 by a pin 21 provided on the fixed metal frame 20, which pin 21 penetrates through a long hole 32 opened in a connecting section 31 on one end of the sliding metal frame 30. By this coupling, the sliding metal frame 30 is openable and slidable in the sliding direction with respect to the fixed metal frame 20, and moreover since the long hole 32 is opened in a perpendicular direction with respect to the sliding direction, the sliding metal frame 30 is movable in the direction perpendicular to the sliding direction within this range of the long hole 32.

Moreover, as shown in FIG. 4, a total of two sliding members 33, one on each long side, are provided projecting from edges of long sides of the sliding metal frame 30 on a surface opposite the plate holding surface, which sliding members 33 are provided symmetrical about a sliding direction center line (longitudinal direction center line) of the sliding metal frame and parallel to the sliding direction. These sliding members 33 have, on each one long side, two each of a sliding contact surface 33*a* and an inclination surface 33*b* that are positioned on a lower surface side in a used state of FIG. 1 and are provided parallel to the slide direction. The inclination surfaces 33*b* are each disposed at identical angles and in identical directions. Here, the sliding contact surfaces are surfaces 33*a* and 46*a* of corresponding sliding members 33 and 46, respectively provided in the sliding metal frame 30 and opening and closing metal frame 40, which surfaces 33*a* and 46*a* include a surface parallel to the sliding direction and which contact each other at the time of casting.

The sliding contact surface 33*a* of the sliding member 33 described above is positioned in front and rear of the sliding direction of the sliding metal frame in a used state of FIG. 1, and thus is called front and rear sliding contact surfaces 33*a* hereafter.

As shown in FIG. 4, the sliding member 33 is integrated as one by sharing a base section 33*c* in a state in which two sliding contact surfaces 33*a* are projected out from the base section 33*c*, and a part between the front and rear sliding contact surfaces 33*a* constitute a depressed part 34. This depressed part 34 forms a space that penetrates through without having any part in contact with the other sliding contact surface in a width direction of the sliding member (direction perpendicular to the sliding direction), at the time of casting. Further, this depressed part is preferably provided at a position symmetrical to each other. By integrating the sliding member 33 as such, there is an advantage that attachment accuracy improves. On the other hand, it is also possible to form the depressed part by not integrating but by providing two sliding members that have the front and rear sliding contact surfaces 33*a*.

With reference to FIG. 1 to FIG. 3, two opening and closing metal frames 40 are provided symmetrical about the sliding direction center line of the sliding metal frame 30, and are each attached to the fixed metal frame 20. The opening and closing metal frame 40 includes a portal arm 41, a spring box 42, a surface pressure guide 48, and a sliding member 46. More specifically, a base end of the portal arm 41 is attached rotationally movable with respect to a pin 22 disposed in the fixed metal frame 20, the spring box 42 is disposed between arms 41*a* of the portal arm 41, and the surface pressure guide 48 is provided integrally with the spring box 42.

The spring box 42 disposes therein a total of four coil springs 43 that are arranged along the sliding direction of the sliding metal frame 30, and a spring pressing plate 44 that are in contact with lower ends of these coil springs 43 and movable inside the spring box 42 in an expanding direction of the coil springs. The spring pressing plate 44 has two coupling bolts 45, and the two coupling bolts 45 penetrate through respective ones of the two coil springs 43 and holes of the spring boxes 42, and are fixed to the base end of the portal arm 41. Moreover, the arms 41*a* of the portal arm 41 have a notch not illustrated, and projections provided on side surfaces of the spring box 42 are penetrated therethrough in a movable manner along a longitudinal axis direction of the coupling bolt 45. Therefore, the spring box 42 is made movable along the longitudinal axis direction of the coupling bolt 45. Further, together with the portal arm 41, the spring box 42 is made rotationally movable with respect to the fixed metal frame 20.

The surface pressure guide 48 is provided integrally with the spring box 42, and similarly is movable along the longitudinal axis direction of the coupling bolt 45. More specifically, the surface pressure guide 48 is provided projecting from the spring box 42 in a nozzle hole direction, and further extends along the sliding direction of the sliding metal frame 30. Further, on the sliding metal frame 30 side of the surface pressure guide 48, a sliding member 46 is provided in a projecting manner. Similarly to the sliding members 33 of the sliding metal frame 30, a total of two sliding members 46 are provided, one on each front and rear for each side, symmetrical about and parallel to the sliding direction center line (longitudinal direction center line) of the sliding metal frame. These sliding members 46 have a sliding contact surface 46*a* and an inclination surface 46*b* positioned on an upper surface in the used state of FIG. 1 and parallel to the sliding direction. Each of the inclination surfaces 46*b* is disposed at identical angles and in identical directions. Moreover, similarly to the sliding member 33 of the sliding metal frame 30, the sliding member 46 is integrated into one by sharing a base section 46*c* in a state in which the two sliding contact surfaces 46*a* are projected from the two base sections 46*c*, and a part between the front and rear sliding contact surfaces 46*a* serves as a depressed part 47.

With reference to FIG. 3, a tip bonding section 72 of a rod 71 of the oil cylinder 70 is attached in a detachable manner to a coupling section 35 of the sliding metal frame 30. The body of the oil cylinder 70 is attached in a detachable manner to an oil cylinder attaching section 23 of the fixed metal frame 20, to allow use of those with different strokes at a time of plate use and at a time of replacement. In the first Example, the use of two oil cylinders with different strokes allow variation in a movable range of the sliding metal frame 30, and allows for loading and releasing surface pressure. A publicly known method of changing a stroke of one oil cylinder may also be employed instead of changing the oil cylinder as described.

Figure 5A:
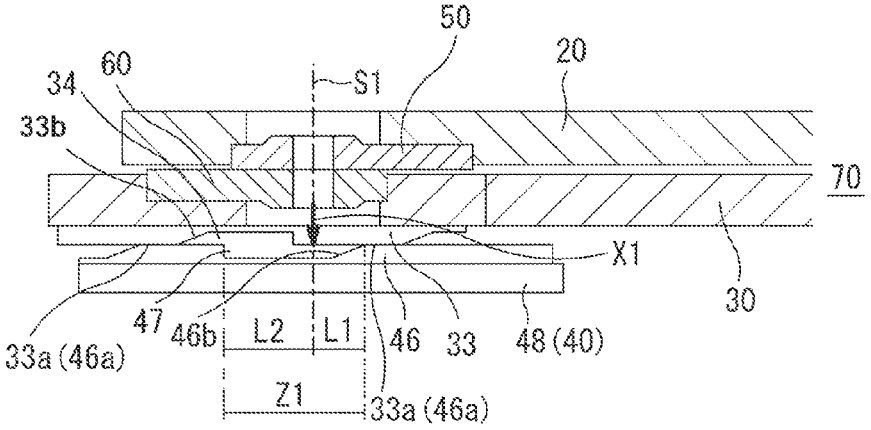
Figure 5B:
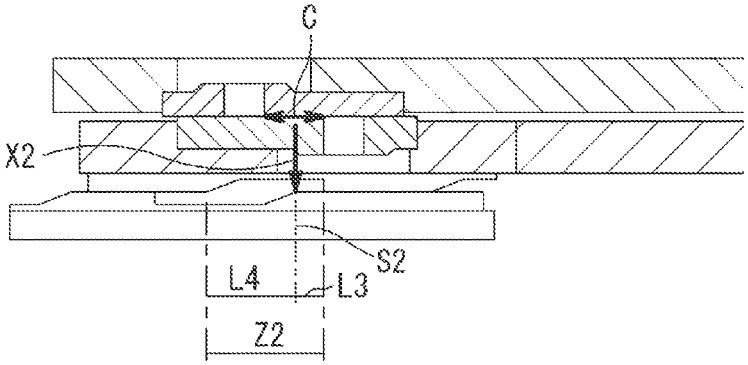
Figure 5C:
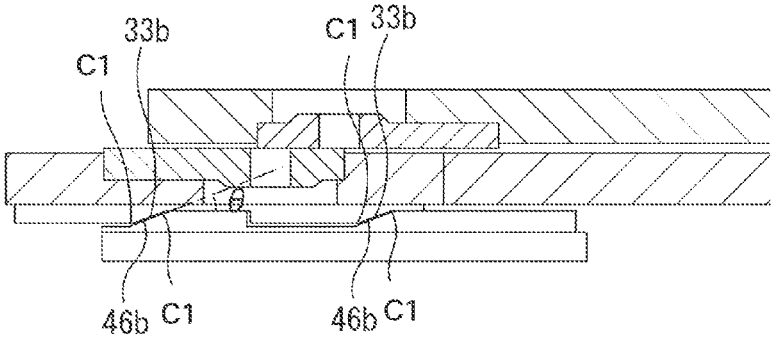

Next described is a positional relationship of the sliding members 33 on the sliding metal frame 30 and the sliding members 46 on the surface pressure guide 48 of the opening and closing metal frame 40, with the upper plate 50 and the lower plate 60, described above with reference to FIGS. 5A-5C. FIGS. 5A-5C show a cross section along a B-B direction in FIG. 3, in which FIG. 5A shows a case in which the sliding metal frame 30 is positioned at a fully open position, FIG. 5B shows a case in which the sliding metal frame 30 is positioned at a fully closed position, and FIG. 5C shows a case in which the sliding metal frame 30 is positioned at a plate replacement position. Here, the fully open position is a position in which the nozzle holes of the upper plate 50 and the lower plate 60 match each other, the fully closed position is a position in which the nozzle holes of the upper plate 50 and the lower plate 60 are furthest away from each other within a movable range of the sliding metal frame 30 at the time of use, and the plate replacement position is a position in which the sliding member 33 on the sliding metal frame 30 and the sliding member 46 on the surface pressure guide 48 can be fit into the depressed part 47 and the depressed part 34, respectively. Moreover, the stroke at the time of use is a movable range of the sliding metal frame 30 at the time of use, and is a distance between centers of the nozzle holes of the upper plate 50 and the lower plate 60 at the fully closed position. Furthermore, in order to achieve a plate replacement position, it is required to change to a driving device (oil cylinder) having a larger stroke than that at the time of use.

In FIG. 5A, the front and rear sliding contact surfaces 46*a* on the surface pressure guide 48 side are positioned away from each other by a total of 180 mm, extending in length whose center is a surface S1 passing through the center axis of the nozzle hole of the upper plate 50 and being perpendicular to the sliding direction, L1=70 mm toward the oil cylinder 70 orientation and L2=110 mm in the opposite direction of the oil cylinder 7, and this part therebetween serves as the depressed part 47 (the nozzle hole diameter is 50 mm) This depressed part 47 serves as a non-sliding contact surface at the time of use, and includes the inclination surface 46*b* part.

In FIG. 5B, the front and rear sliding contact surfaces 33*a* on the sliding metal frame 30 are positioned away from each other by a total of 170 mm, extending in length whose center is a surface S2 passing through a center of the most important surface of the lower plate 60 and being perpendicular to the sliding direction, L3=60 mm toward the oil cylinder 70 orientation and L4=110 mm in the opposite direction of the oil cylinder 70, and this part therebetween serves as the depressed part 34. This depressed part 34 also serves as a nonsliding contact surface at the time of use, and includes the inclination surface 33*b* part.

In FIGS. 5A-5C, a width of the sliding contact surfaces 33*a* and 46*a* is 40 mm, a total of a minimum sliding contact area later described is 80 $cm^2$, the pressure applied on the sliding contact surfaces 33*a* and 46*a* is 6 $N/mm^2$, the thickness of the sliding metal frame 30 is 30 mm, the stroke at the time of use is 120 mm, and the stroke at the time of replacement is 220 mm. Each of the upper and lower plates 50 and 60 used have an entire length of 300 mm, a width of 150 mm, a thickness of 35 mm, and a nozzle hole diameter of 50 mm.

The most important surface of the upper and lower plates here refers to a range shown by the arrow C in FIG. 5B, namely, a surface range of the each of the plates whose length in the sliding direction is of a shortest distance from an end of the nozzle hole of one plate to an end of the nozzle hole of the other plate in the fully closed position of the plate, and whose width is of a range around 1.2 times the nozzle hole diameter. That is to say, the length of the most important surface is the length of the most important surface in the sliding direction, and for example the length of the most important surface in FIGS. 5A-5C is 70 mm. This length of the most important surface is a value subtracting the nozzle hole diameter of 50 mm from the stroke at the time of use of 120 mm. The width of the most important surface is usually made symmetrical about a straight line connecting the centers of the nozzle holes of the upper and lower plates.

Next described is the movement of the sliding device of the present invention.

First, at the time of plate replacement, the tip bonding section 72 of the rod of the oil cylinder 70 is taken off from the coupling section 35 of the sliding metal frame 30 in FIG. 3, and the oil cylinder 70 is taken off from the oil cylinder attaching section 23 and is replaced with an oil cylinder having a larger stroke.

The sliding metal frame 30 is then slid leftwards from the fully closed position of FIG. 5B, and is moved to the plate replacement position of FIG. 5C. This causes the sliding member 46 on the surface pressure guide 48 to move to the fixed metal frame 20 side, and the spring box 42 shown in FIG. 2 is moved to the fixed metal frame 20 side, thus eliminating the bend in the coil spring 43 and releasing the surface pressure. The inclination surfaces 33*b* and 46*b* of the sliding members 33 and 46 are provided to smoothly move the respective sliding members 33 and 46 in a sliding manner when the surface pressure is released or loaded as described above.

In a state in which the surface pressure is released, the two opening and closing metal frames 40 can be opened as shown in FIG. 4, and further the sliding metal frame 30 can be opened to replace the upper and lower plates.

After the plates are replaced, the sliding metal frame 30 and the opening and closing metal frame 40 are closed, and the sliding metal frame 30 is slid from the plate replacement position of FIG. 5C to the fully closed position of FIG. 5B. As a result, the sliding contact surfaces 33*a* and 46*a* of respective ones of the sliding member 33 on the sliding metal frame 30 and the sliding member 46 on the surface pressure guide 48 come in contact with each other, and the coil spring 43 bends due to the spring box 42 shown in FIG. 2 being moved to the opposite side of the fixed metal frame 20, thus applying surface pressure thereon. Replacement of an oil cylinder with a smaller stroke is carried out in a state in which the surface pressure is applied. This thus allows for safe use without the surface pressure being released at the time of use.

Here, if the sliding metal frame 30 is to be slid rightwards from the state of FIG. 5C to load surface pressure, since each of the sliding members 33 and 46 have inclination surfaces 33*b* and 46*b* continuing from the bottom surfaces of the depressed parts to the sliding contact surfaces 33*a* and 46*a*, respectively, first, the inclination surfaces 33*b* and 46*b* come in contact with each other. In order to reduce the friction resistance at this time of loading surface pressure to allow smooth sliding movement of the sliding members 33 and 46, all inclination angles and orientation of the inclination surfaces 33*b* and 46*b* are made the same, and further the inclination angle θ (see FIG. 5C) may be 25 degrees or less, more preferably 20 degrees or less. In order to reduce the resistance at the time of sliding movement and further reduce any damage on the surface of the sliding members 33 and 46, and in a case of making the device more compact, the inclination angle θ is 10 degrees or more, preferably 14 degrees or more.

Moreover, in order to similarly reduce the friction resistance at the time of surface pressure loading, an R is provided in corner sections C1 (see FIG. 5C) where the inclination surfaces 33*b* and 46*b* and the sliding contact surface 33*a* and 46*a* continue, and the R of these corner sections C1 may be 40 mm or more, preferably 50 mm or more. Moreover, when the R of the corner sections C1 increase, the friction resistance is reduced and thus allows for smooth sliding, however if the R is too large, the sliding contact surfaces 33*a* and 46*a* of the sliding members 33 and 46 become shorter by that amount; in order to provide the sliding contact surfaces 33*a* and 46*a* of a predetermined length, the sliding members 33 and 46 become long and thus the device becomes large. In a case of reducing the size of the device, R is 180 mm or less, more preferably 150 mm or less.

Moreover, in order to reduce the occurrence of any damage on the surface of the sliding members 33 and 46 at the time of sliding, it is preferable that Shore hardness Hs of the surface of the sliding members 33 and 46 is 60 or more, more preferably 70 or more.

Next described is a positional relationship between the nozzle hole of the plate and the depressed part 47, and between the most important surface and the depressed part 34, at the time of use.

In FIG. 5A, molten steel is discharged at the fully open position. During the actual casting, the lower plate 60 is moved a little more towards the oil cylinder 70 to vary the aperture of the nozzle hole, to control the molten steel flow rate. At this time, the range shown by the arrow Z1 is a part in which the sliding member 46 does not contact at the sliding contact surface 46*a* by the presence of the depressed part 47, and the nozzle hole is positioned above this part. When the surroundings of the nozzle hole expand in the center axis direction of the nozzle hole in this state, the sliding metal frame 30 can warp in the direction of the arrow X1 as compared to a case in which a sliding member not having the conventional depressed part is used. This allows for the plate to warp with respect to the sliding metal frame 30, and the plates can be in contact with each other at broader surfaces. Therefore, it is possible to reduce chipping in the nozzle hole surroundings of the plate caused by the frequent sliding movement for the adjustment of the aperture of the nozzle hole and any damage on the most important surface.

When the casting is terminated, the sliding metal frame 30 is slid from a state in FIG. 5A or one close to this state, to the fully closed position in FIG. 5B. At this time, the most important surface C of the upper plate 50 and the lower plate 60 in slidable contact with each other, are positioned in the range shown by the arrow Z2, namely, above a part in which the sliding member 33 is not in contact at the sliding contact surface 33*a* by the presence of the depressed part 34. Therefore, even if a region in which temperatures of both the upper plate 50 and the lower plate 60, namely, the most important surface is expanded in the center axis direction of the nozzle hole, the sliding metal frame 30 can warp in the arrow X2 direction as compared to a case in which a sliding member not formed with the conventional depressed part is used. As a result, the plate can warp with respect to the sliding metal frame 30 and the plates can come in contact with each other at broader surfaces. As a result, it is possible to reduce the surface roughness of the most important surface of the upper plate and lower plate accompanying the sliding.

Figure 6:
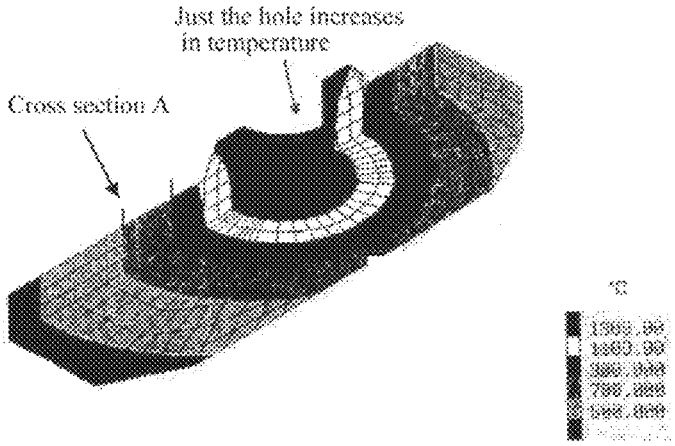
FIG. 6 shows an example of a temperature distribution calculated by FEM, at a time of using an upper plate.
Figure 7:
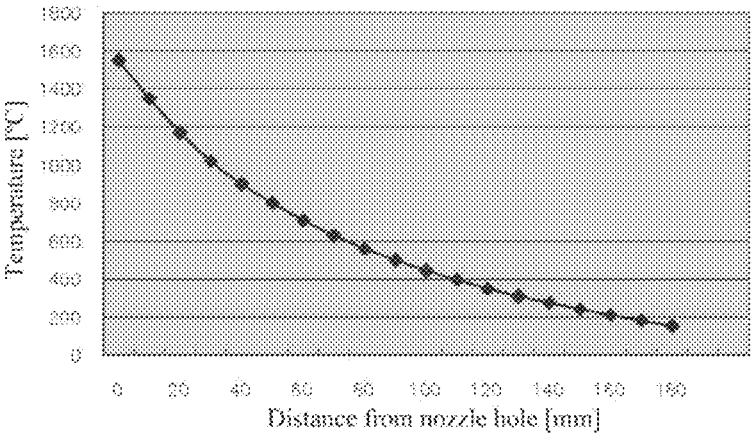
FIG. 7 is a graph showing the temperature of the cross section A in FIG. 6.
Figure 8:
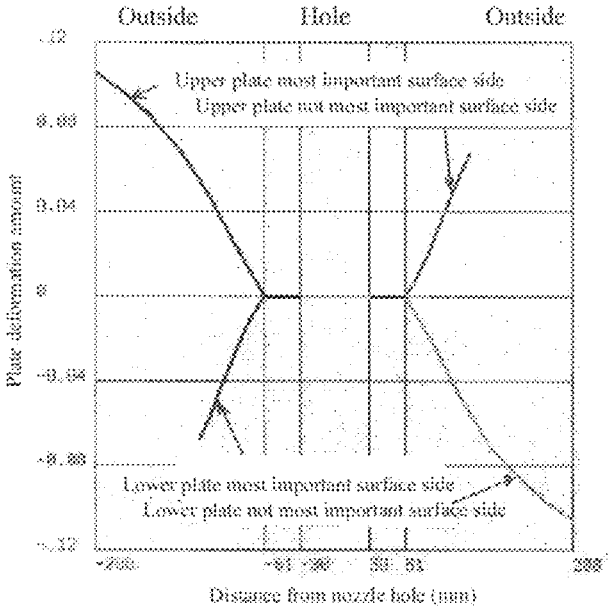
FIG. 8 is an example of a plate deformation amount calculated by FEM.

FIG. 6 and FIG. 7 show examples of a temperature part of the upper plate at the time of use, calculated by FEM. FIG. 6 is a view displaying a temperature distribution of the plate in a three dimensional manner, and FIG. 7 shows temperatures of the cross section A of FIG. 6 in a graph. The calculation conditions are, a plate made of alumina carbon material, whose length is 330 mm, width is 180 mm, thickness is 30 mm, nozzle hole diameter is 60 mm, and with a molten steel temperature of 1550° C. Moreover, FIG. 8 shows an FEM calculation result of a deformed amount of a plate in a case in which the plate is used in a sliding nozzle device under the same conditions and further with a pressure of St, and which a liner of the sliding metal frame and a liner of the opening and closing metal frame are in contact with each other in a sliding manner for the whole length of the sliding range as in Patent document 2. This FIG. 8 shows the variation in dimension in a cross section perpendicular to the longitudinal direction center axis of the plate in a state in which the upper plate and the lower plate are in the fully open position and are in contact with each other at a high pressure. The horizontal axis indicates a distance, wherein 0 is the center axis of the nozzle hole of the plate, and the vertical axis indicates a plate deformed amount, wherein 0 is the contact surface of the plates.

It can be seen from FIG. 7 that the temperature is high around up to 30 mm from the edge of the nozzle hole (60 mm from the center of the nozzle hole), with a temperature of approximately 1000° C. or more, and as the distance exceeds 30 mm from the edge of the nozzle hole, the decrease in temperature becomes moderate. Moreover, it can be seen from FIG. 8 that although the upper plate and the lower plate are close together since the range in the width of 31 mm around the nozzle hole becomes high in temperature and expands greatly, as the distance increases from the nozzle hole further, the degree of expansion becomes small and spaces generate therebetween.

On the other hand, although the plate varies in size depending on the use conditions, most are within the ranges of a whole length of 200 mm to 450 mm, a width of 150 mm to 250 mm, a nozzle hole diameter of 40 mm to 90 mm, and a thickness of 25 mm to 35 mm, and the temperature of the molten steel is around 1550° C. Among the aforementioned, the temperature distribution of the plate is considered to be affected the most by the area of the nozzle hole. That is to say, it is considered that the heat receiving amount increases and the temperature is high to a further position as the area of the nozzle hole increases, and the temperature is proportional to the nozzle hole diameter. From this point, the position of the depressed part provided to the surface pressure guide is defined by having the nozzle hole diameter serve as a standard.

Namely, it is important to provide the front and rear sliding contact surfaces 46*a* of the surface pressure guide 48 away from each other in the front and rear of the slide direction, each by a distance of the nozzle hole diameter or more, whose center thereof being a surface passing through a center axis of the nozzle hole of the upper plate 50 and perpendicular to the sliding direction, and to have the part between the front and rear sliding contact surfaces 46*a* serve as the depressed part 47. In a case in which the length to be separated is each smaller than the nozzle hole diameter, the sliding metal frame 30 cannot be sufficiently warped, and the damage prevention effect around the nozzle hole surroundings of the upper plate and the most important surface becomes insufficient.

For example, in the case of FIG. 8, in order to buffer the expansion around the nozzle hole surroundings of the upper plate at the least, the warping margin for the opening and closing metal frame can be mostly secured by providing 60 mm or more at both the front and rear in the sliding direction whose center is the nozzle hole, having a total of 120 mm or more of the depressed parts of the sliding member on the surface pressure guide.

Moreover, the position of the depressed part 34 on the sliding metal frame 30 relates to the damage prevention effect of the most important surface. Damage on the most important surface also occurs upon sliding from the fully open state or a state close thereto to the fully closed state. When sliding to this fully closed position, the nozzle hole surroundings of the lower plate comes into sliding contact with the most important surface of the upper plate, and the nozzle hole surroundings of the upper plate comes into sliding contact with the most important surface of the lower plate. At this time, the surroundings of the nozzle hole is expanded, so the thermal expansion into the axis direction of the nozzle increases particularly at parts where the most important surfaces contact each other. Accordingly, by providing the depressed part 34 to the sliding member 33 on the sliding metal frame 30 that does not vary in position with respect to the most important surface of the lower plate, the sliding metal frame warps, and allows for buffering the effect caused by this thermal expansion.

Therefore, when there is a necessity to prevent any damage on the most important surface, the sliding contact surfaces 33*a* that are front and rear of the sliding metal frame 30 can be provided away from each other by a length longer than a length of the most important surface whose center is a surface passing through the center of the most important surface of the lower plate and being perpendicular to the sliding direction, and the part between the front and rear sliding contact surfaces 33*a* serves as the depressed part 34.

In a case of reducing the surface roughness of the plate by loading an even surface pressure to the whole surface of the plate, a minimum sliding contact surface area by a total of 40 $cm^2$ or more of the sliding contact surface 33*a* of the sliding member 33 can be secured.

The minimum sliding contact surface area here is a minimum value of an area on which the sliding contact surfaces 33*a* and 46*a* contact each other, at the time of use. For example in the first Example, the area on which the sliding contact surfaces 33*a* and 46*a* contact each other is the smallest at the fully open position in FIG. 5A, and the area of the part in contact with each other at one location is 20 $cm^2$, and the total of four locations is 80 $cm^2$.

Although the pressure applied to the sliding contact surface can be selected as appropriate with respect to a damaged state of the plate and a state of the sliding contact surface, for further making the sliding movement of the sliding members 33 and 46 more smooth and reducing any damage made on the plate, it is possible to make the pressure applied on the sliding contact surfaces 33*a* and 46*a* at the time of use to be 10 $N/mm^2$ (approximately 100 $kgf/cm^2$) or less.

In order to increase the sliding contact surface or reduce the pressure applied on the sliding contact surface, it is possible to widen the width of the sliding contact surface as compared to the conventional sliding contact surface of the sliding nozzle device, and more specifically, a suitable value may be selected within a range of 25 mm or more to 60 mm or less.

Moreover, although a thickness of a sliding metal frame of a conventional general sliding nozzle device is sufficient in order for the sliding metal frame to warp and absorb thermal stress of the plate, more specifically, the thickness of the sliding metal frame is more preferably in a range of 20 mm or more to 40 mm or less.

As described above, in the first Example, by attaining a relationship in which a counterpart sliding member is fit to a depressed part formed between the sliding contact surfaces, it is possible to achieve two effects, an effect of reducing damage on the plate and being capable of loading and releasing the surface pressure automatically.

Next, Tables 1 and 2 show results of carrying out a slide movement test for the sliding member in the sliding nozzle device of the first Example by varying the inclination angle θ of the inclination surface and R of the corner sections. Furthermore, Table 3 shows a result of carrying out a slide movement test by varying the hardness of the surface of the sliding member. As to the hardness of the surface of the sliding member, those having different Shore hardness Hs were prepared by changing thermal processing conditions of the sliding member made of carbon steel. The Shore hardness Hs was measured by a test method defined in JIS Z 2246. The Shore hardness of the sliding members in Tables 1 and 2 were 80.

In the slide movement test, the surface of the sliding member was heated by a burner. At a time point when 300° C. is reached, a lubricant is applied on the surface, the sliding metal frame is reciprocated 10 times to load and release surface pressure, and the degree of surface damage on the sliding member was assessed. Moreover, the degree of noise generated from the sliding member during the slide movement test was also assessed. These surface damages and noises were evaluated into four stages, of "None", "Small", "Mid", and "Large". The temperature of the sliding member was measured with a surface thermometer. The total surface pressure was 6 kN in a state in which the surface pressure was totally applied.

TABLE 1

| | Ex. 2 | Ex. 3 | Ex. 4 | Ex. 5 | Ex. 6 |
|---|---|---|---|---|---|
| Inclination angle (degrees) | 14 | 17 | 20 | 25 | 30 |
| R in corner section (mm) | 100 | 100 | 100 | 100 | 100 |
| Surface damage | None | Small | Small | Small | Mid |
| Noise | None | Small | Small | Mid | Mid |

Ex.: Example

TABLE 2

| | Ex. 7 | Ex. 8 | Ex. 9 | Ex. 10 | Ex. 11 | Ex. 12 |
|---|---|---|---|---|---|---|
| R in corner section (mm) | 30 | 40 | 50 | 80 | 130 | 150 |
| Inclination angle (degrees) | 20 | 20 | 20 | 20 | 20 | 20 |
| Surface damage | Mid | Small | Small | Small | None | None |
| Noise | Mid | Mid | Small | Small | None | None |

Ex.: Example

TABLE 3

| | Ex. 13 | Ex. 14 | Ex. 15 | Ex. 16 | Ex. 17 |
|---|---|---|---|---|---|
| Shore hardness Hs | 70 | 80 | 90 | 60 | 50 |
| R in corner section (mm) | 100 | 100 | 100 | 100 | 100 |
| Inclination angle (degrees) | 15 | 15 | 15 | 15 | 15 |
| Surface damage | None | None | Small | Small | Small |
| Noise | None | None | None | Small | Mid |

Ex.: Example

In Table 1, Example 2 to Example 5 had "None" to "Mid" noise generated from the sliding member during the slide movement test, and had "None" or "Small" surface damage on the sliding member after the test, and thus was good. In Example 6 whose inclination angle θ of the inclination surface of the sliding member was large, a damage around "Mid" level was generated on the surface of the sliding member, and a noise of around "Mid" level generated during the test.

In Table 2, Example 8 to Example 12 had "None" to "Mid" noise generated from the sliding member during the slide movement test, and had "None" or "Small" surface damage on the sliding member after the test, and thus was good. In Example 7 whose R in the corners of the sliding member was small, a damage of "Mid" level generated on the surface of the sliding member and a noise of "Mid" level also generated during the test.

In Table 3, Example 13 to Example 16 had "None" or "Small" noise generated from the sliding member during the slide movement test, and had "None" or "Small" surface damage on the sliding member after the test, and thus was good. In Example 17 whose Shore hardness Hs of the surface of the sliding member was 50, a Mid-level noise generated on the sliding member surface, but the degree of the surface damage after the test was "Small".

Next, a result of using the sliding nozzle device of Example 4 of the present invention in an actual ladle of molten steel of 180 t is shown in Table 4. As a comparative example, a sliding nozzle device was used, which uses two liners made of metal extending in the sliding directions of each of the sliding metal frame and the opening and closing metal frame that are the type of Patent Document 2. The plate used was of alumina carbon based material, and has a length of 330 mm, a width of 150 mm, and a nozzle hole diameter of 60 mm. The test was carried out by observing the surface state of the plate every one use to determine whether the plate is usable or not. Table 4 shows an average number of uses of 10 sets of plates. From Table 4, it was found that the plates used in the sliding nozzle device of the present invention have less surface roughness on the most important surface and less damage in the nozzle hole surroundings as compared to the Comparative Example, and thus have excellent durability.

TABLE 4

| | Example | Comparative Example |
|---|---|---|
| No. of use (times) | 5.5 | 4.1 |

The present invention is not limited to the aforementioned Examples, and is applicable as long as it is a sliding nozzle device of a system in which the sliding metal frame and the opening and closing metal frame come into slidable contact with each other on their sliding contact surfaces. Moreover, for the system of loading and releasing the surface pressure, it is also applicable even for systems not carrying out the surface pressure automatically, for example a bolt screwing system.

REFERENCE NUMERALS

10 sliding nozzle device
20 fixed metal frame
21,22 pin
23 oil cylinder attaching section
30 sliding metal frame
31 coupling section
32 long hole
33 sliding member
33*a* sliding contact surface
33*b* inclination surface
33*c* base section
34 depressed part
35 coupling section
40 opening and closing metal frame
41 portal arm
41*a* arm
42 spring box
43 coil spring
44 spring pressing plate
45 coupling bolt
46 sliding member
46*a* sliding contact surface
46*b* inclination surface
46*c* base section
47 depressed part
48 surface pressure guide
50 upper plate
60 lower plate
70 oil cylinder
71 rod
72 tip bonding section

What is claimed is:

1. A sliding nozzle device comprising:

a fixed metal frame;

an upper plate fixed to the fixed metal frame, the upper plate having a nozzle hole;

a sliding metal frame;

a lower plate fixed to the sliding metal frame, the lower plate having a nozzle hole of identical diameter to the nozzle hole of the upper plate, the sliding metal frame being configured to linearly slide so as to move the lower plate in a sliding manner with respect to the upper plate;

an elastic body for loading surface pressure between the upper plate and the lower plate;

an opening and closing metal frame attached to the fixed metal frame, the opening and closing metal frame holding the sliding metal frame in a slidable manner; and a driving device for the sliding metal frame, wherein the sliding metal frame and the opening and closing metal frame each have a sliding member disposed symmetrical about a sliding direction center line of the sliding metal frame and parallel to a sliding direction, the sliding members being in contact with each other on their sliding contact surfaces in a sliding manner, the sliding contact surfaces of the sliding member of the opening and closing metal frame are provided front and rear along the sliding direction, away from each other by a length of at least the diameter of the nozzle holes from a plane serving as a center, the plane passing through a center axis of the nozzle hole of the upper plate and being perpendicular to the sliding direction, and a part of the sliding member of the opening and closing metal frame between the front and rear sliding contact surfaces is a recessed portion of the sliding member of the opening and closing metal frame.

2. The sliding nozzle device according to claim 1, wherein the sliding contact surfaces of the sliding member of the sliding metal frame are provided front and rear along the sliding direction, away from each other by a length of at least the shortest distance from one end of the nozzle hole of one of the plates to one end of the nozzle hole of the other of the plates in a fully closed position of the upper and lower plates, and a part of the sliding member of the sliding metal frame between the front and rear sliding contact surfaces is a recessed portion of the sliding member of the sliding metal frame.

3. The sliding nozzle device according to claim 1, wherein a total of a minimum sliding contact area, which is a minimum value of an area at which the sliding contact surfaces contact each other at a time of use, is at least 40 $cm^2$.

4. The sliding nozzle device according to claim 1, wherein the sliding member on the sliding metal frame is capable of being fit into the recessed portion of the opening and closing metal frame, and by sliding the sliding metal frame, surface pressure is released when the sliding member on the sliding metal frame is fit into the recessed portion of the opening and closing metal frame, and surface pressure is loaded when the sliding member on the opening and closing metal frame and the sliding member on the sliding metal frame contact each other via their sliding contact surfaces.

5. The sliding nozzle device according to claim 4, wherein the sliding member on the opening and closing metal frame has an inclination surface continuing from a bottom surface of the recessed portion to the sliding contact surface in the sliding direction, and this inclination surface has an inclination angle of 25 degrees or less, and an R of a corner section where the inclination surface and the sliding contact surface continue is at least 40 mm.

6. The sliding nozzle device according to claim 5, wherein each of the sliding members has a surface Shore hardness Hs of 60 or more.

7. The sliding nozzle device according to claim 2, wherein the sliding members on the opening and closing metal frame and the sliding members on the sliding metal frame are capable of being fit into the recessed portions of the sliding metal frame and the opening and closing metal frame, and by sliding the sliding metal frame, surface pressure is released when the sliding member on the opening and closing metal frame and the sliding member on the sliding metal frame are fit into the recessed portions of the sliding metal frame and the opening and closing metal frame, and surface pressure is loaded when the sliding member on the opening and closing metal frame and the sliding member on the sliding metal frame contact each other via their sliding contact surfaces.

8. The sliding nozzle device according to claim 7, wherein the sliding member on the opening and closing metal frame has an inclination surface continuing from a bottom surface of the recessed portion to the sliding contact surface in the sliding direction, and these inclination surfaces have identical inclination angles and directions, with the inclination angle being 25 degrees or less, and an R of a corner section where the inclination surface and the sliding contact surface continue being at least 40 mm.

9. The sliding nozzle device according to claim 8, wherein each of the sliding members has a surface Shore hardness Hs of 60 or more.

10. The sliding nozzle device according to claim 3, wherein the sliding member on the sliding metal frame is capable of being fit into the recessed portion of the opening and closing metal frame, and by sliding the sliding metal frame, surface pressure is released when the sliding member on the sliding metal frame is fit into the recessed portion of the opening and closing metal frame, and surface pressure is loaded when the sliding member on the opening and closing metal frame and the sliding member on the sliding metal frame contact each other via their sliding contact surfaces.

11. The sliding nozzle device according to claim 10, wherein the sliding member on the opening and closing metal frame has an inclination surface continuing from a bottom surface of the recessed portion to the sliding contact surface in the sliding direction, and this inclination surface has an inclination angle of 25 degrees or less, and an R of a corner section where the inclination surface and the sliding contact surface continue is at least 40 mm.

12. The sliding nozzle device according to claim 11, wherein each of the sliding members has a surface Shore hardness Hs of 60 or more.

13. The sliding nozzle device according to claim 2, wherein a total of a minimum sliding contact area, which is a minimum value of an area at which the sliding contact surfaces contact each other at a time of use, is at least 40 $cm^2$.

14. The sliding nozzle device according to claim 13, wherein the sliding members on the opening and closing metal frame and the sliding members on the sliding metal frame are capable of being fit into the recessed portions of the sliding metal frame and the opening and closing metal frame, and by sliding the sliding metal frame, surface pressure is released when the sliding member on the opening and closing metal frame and the sliding member on the sliding metal frame are fit into the recessed portions of the sliding metal frame and the opening and closing metal frame, and surface pressure is loaded when the sliding member on the opening and closing metal frame and the sliding member on the sliding metal frame contact each other via their sliding contact surfaces.

15. The sliding nozzle device according to claim 14, wherein the sliding member on the opening and closing metal frame has an inclination surface continuing from a bottom surface of the recessed portion to the sliding contact surface in the sliding direction, and these inclination surfaces have identical inclination angles and directions, with the inclination angle being 25 degrees or less, and an R of a corner section where the inclination surface and the sliding contact surface continue being at least 40 mm.

16. The sliding nozzle device according to claim 15, wherein each of the sliding members has a surface Shore hardness Hs of 60 or more.

17. A sliding nozzle device comprising:

a fixed metal frame;

an upper plate fixed to the fixed metal frame, the upper plate having a nozzle hole;

a sliding metal frame;

a lower plate fixed to the sliding metal frame, the lower plate having a nozzle hole of identical diameter to the nozzle hole of the upper plate, the sliding metal frame being configured to linearly slide so as to move the lower plate in a sliding manner with respect to the upper plate; and an opening and closing metal frame attached to the fixed metal frame, the opening and closing metal frame holding the sliding metal frame in a slidable manner, wherein the sliding metal frame and the opening and closing metal frame each have a sliding member disposed symmetrical about a sliding direction center line of the sliding metal frame and parallel to a sliding direction, the sliding members being in contact with each other on their sliding contact surfaces in a sliding manner, the sliding contact surfaces of the sliding member of the opening and closing metal frame are provided front and rear along the sliding direction, away from each other by a length of at least the diameter of the nozzle holes from a plane serving as a center, the plane passing through a center axis of the nozzle hole of the upper plate and being perpendicular to the sliding direction, and a part of the sliding member of the opening and closing metal frame between the front and rear sliding contact surfaces is a recessed portion of the sliding member of the opening and closing metal frame.

18. The sliding nozzle device according to claim 17, wherein the sliding contact surfaces of the sliding member of the sliding metal frame are provided front and rear along the sliding direction, away from each other by a length of at least the shortest distance from one end of the nozzle hole of one of the plates to one end of the nozzle hole of the other of the plates in a fully closed position of the upper and lower plates, and a part of the sliding member of the sliding metal frame between the front and rear sliding contact surfaces is a recessed portion of the sliding member of the sliding metal frame.

19. The sliding nozzle device according to claim 18, wherein a total of a minimum sliding contact area, which is a minimum value of an area at which the sliding contact surfaces contact each other at a time of use, is 40 $cm^2$.

* * * * *